US005499487A

United States Patent [19]

McGill

[11] Patent Number: 5,499,487

[45] Date of Patent: Mar. 19, 1996

[54] METHOD AND APPARATUS FOR FILLING A BALL GRID ARRAY

[75] Inventor: Scott D. McGill, Tucson, Ariz.

[73] Assignee: Vanguard Automation, Inc., Tucson, Ariz.

[21] Appl. No.: 306,144

[22] Filed: Sep. 14, 1994

[51] Int. Cl.[6] ..... B65B 5/10

[52] U.S. Cl. ..... 53/473; 53/246; 53/539

[58] Field of Search ..... 53/473, 475, 246, 53/251, 250, 249, 263, 247, 244, 255, 235, 539

[56] References Cited

U.S. PATENT DOCUMENTS

| | | | |
|---|---|---|---|
| 2,613,861 | 10/1952 | Goerlitz | 53/246 X |
| 3,298,404 | 1/1967 | Eisenberg | 53/473 X |
| 3,696,581 | 10/1972 | Eisenberg | 53/473 X |
| 3,789,575 | 2/1974 | Bross | 53/539 X |
| 4,546,594 | 10/1985 | Mohaupt | 53/473 X |

*Primary Examiner*—James F. Coan
*Attorney, Agent, or Firm*—Herbert M. Shapiro

[57] ABSTRACT

The reliable population of a ball grid array is achieved by attaching the array to the inner face of a wheel which is rotatable about a central axis. A tooling fixture is attached to the outer face of the wheel. Each of the ball grid array and the tooling fixture has a face with recesses and the faces face one another. The wheel moves the tooling fixture into a reservoir of solder balls to populate the recesses in the tooling fixture and the solder balls are dropped into the corresponding recesses of the ball grid array when the wheel rotates to a position where the recesses in the ball grid array are beneath the recesses in the tooling fixture. The array and the fixture are spaced apart initially so that the rotation of the wheel moves only the fixture through the reservoir ensuring that all recesses in the fixture are filled and that all solder balls not occupying recesses are removed from the surface of the fixture by the force of gravity as the wheel turns. The array and the fixture are moved together for the transfer of the solder balls to the ball grid array.

10 Claims, 6 Drawing Sheets

METHOD AND APPARATUS FOR FILLING A BALL GRID ARRAY

FIELD OF THE INVENTION

This invention relates to ball grid arrays and more particularly to the placement of solder balls in such arrays.

BACKGROUND OF THE INVENTION

Ball grid arrays are available commercially from AMKOR/ANAM, Korea. Such arrays comprise a plastic film with an array of recesses, each recess providing a receptacle for a solder ball. The arrays are available in strips which may be detached from one another. The recesses are small and closely spaced from one another. Thus the placement of solder balls reliably into the recesses is a difficult task.

Various techniques have been devised to place the solder balls in the recesses. One technique, developed by employs a vacuum chuck with a number of holes corresponding to the recesses in the ball grid array. The holes are defined in a shift plate which moves to release the balls into the ball grid array therebeneath when the vacuum is removed. Another method employs a "dip strip" which captures the balls and then mates with the ball grid array to transfer the Such techniques have been found to be unreliable and expensive to implement. Also, particularly in the latter technique, the balls are not accurately positioned in the recesses. Also, such techniques do not reliably populate the ball grid array Further, the recesses of the array are larger than the solder balls and the above-noted mating technique places the balls in various positions in the recesses, in positions which are sufficiently different to be misplaced when integrated with a microcircuit, thus rendering the microcircuit inoperative.

BRIEF DESCRIPTION OF THE INVENTION

In accordance with the principles of this invention, a cylindrical gantry, rotatable about a central axis much like a Ferris Wheel, is employed for filling the ball grid array with solder balls. A ball grid array strip is secured to the inner face of the gantry and a tooling fixture is secured to the outer face of the gantry in a position corresponding to that of the ball grid array. A reservoir is positioned at the bottom of the gantry and is filled with solder balls. The gantry is rotated to move the tooling fixture through the reservoir of solder balls to fill recesses in the tooling fixture with solder balls. The gantry is rotated further upwards to a position where solder balls not positioned in recesses of the tooling fixture fall back into the reservoir. Gravity also ensures that the solder balls captured in the recesses of the tooling fixture always move to the same position in the recesses thus providing predictable positions for the solder balls even though the recesses are larger than the solder balls.

The tooling fixture is coupled to an associated ball grid array, illustratively, by means of a rail and solenoid arrangement which pushes the tooling fixture into juxtaposition with the associated ball grid array at a point in the operation where gravity operates to move the solder balls, captured by the tooling fixture, into the corresponding recesses of the ball grid array.

DETAILED DESCRIPTION OF AN ILLUSTRATIVE EMBODIMENT OF THIS INVENTION

Figure 1:
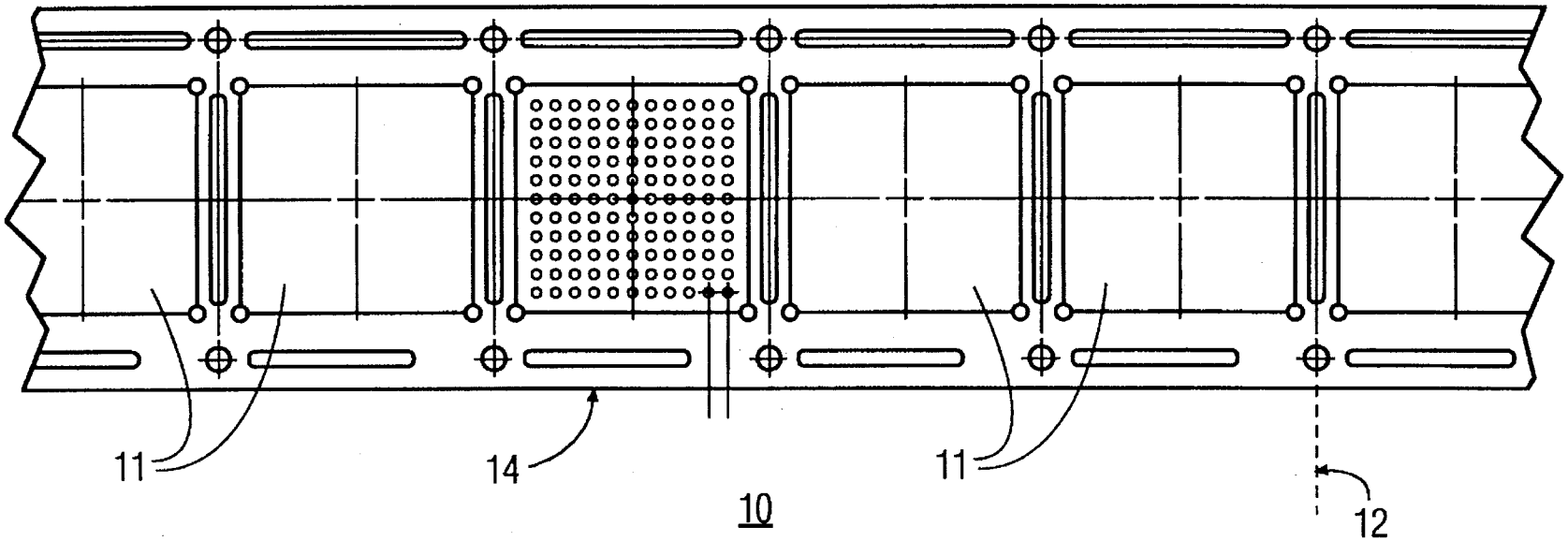
FIG. 1 PRIOR ART
FIG. 1 is a top view of a representative, commercially available, ball grid array strip.

FIG. 1 shows a top view of a ball grid array strip 10 which is available, for example, from AMKOR/ANAM, Korea. The strip is comprised of a plurality of individual ball grid arrays 11. The individual arrays can be separated from one another along lines indicated by the broken line at 12. The ball grid array recesses are shown as an 11×11 array at 14 in the figure resulting in an array of 121 solder ball recesses, each 0.63 thousandths in diameter on 1.27 thousandths centers.

Figure 2:
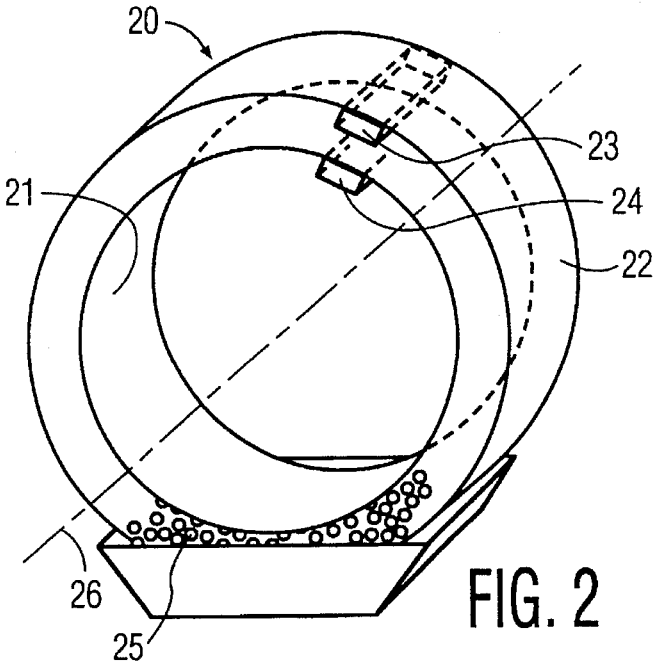
FIG. 2 is a schematic view of a Ferris Wheel apparatus for filling ball grid arrays in accordance with the principles of this invention.

FIG. 2 shows, schematically, a "Ferris Wheel" type apparatus for filling a ball grid array in accordance with the principles of this invention. The wheel comprises a circular gantry 20 having an inner face 21, an outer face 22 and a thickness of about one inch. A tooling fixture 23 is attached to the outer face of the wheel and a ball grid array 24 is attached to the inner face of the wheel in a position corresponding to that of the tooling fixture. A reservoir 25 of solder balls is positioned at the bottom of the wheel.

In operation, the wheel is rotated about axis 26 so that the tooling fixture 23 moves through the reservoir while the ball grid array does not engage the solder balls in the reservoir. The thickness of the wheel thus can be seen to be arbitrary, but is related to the depth of the reservoir and the necessity for rigidity.

Figure 3:
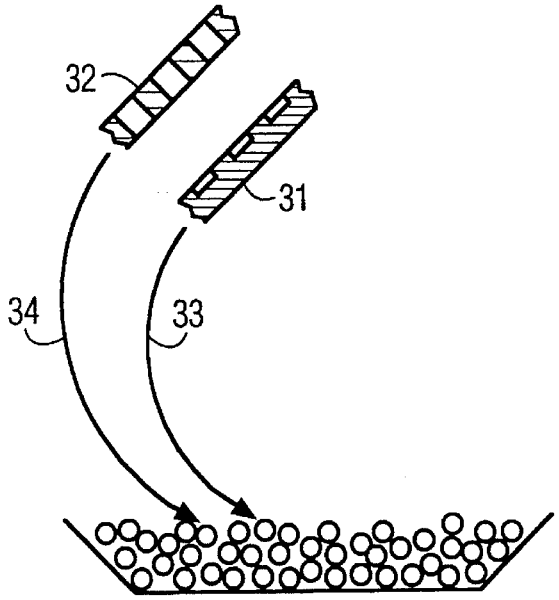
FIGS. 3, 4, 5, and 6 are schematic representations of a representative ball grid array strip and associated tooling fixture affixed to a Ferris Wheel apparatus of FIG. 2 as the wheel moves to consecutive positions during the operation.

FIGS. 3, 4, 5, and 6 illustrate, schematically, the sequential positions of a ball grid array and the associated tooling fixture as the wheel of FIG. 2 rotates in a manner to move the tooling fixture through the reservoir of solder balls. Specifically, FIG. 3 is a schematic side view of an illustrative ball grid array 31 and associated tooling fixture 32. The components (31 and 32) are moving downwards and to the right as indicated by the curved arrows 33 and 34 in FIG. 3.

Figure 4:
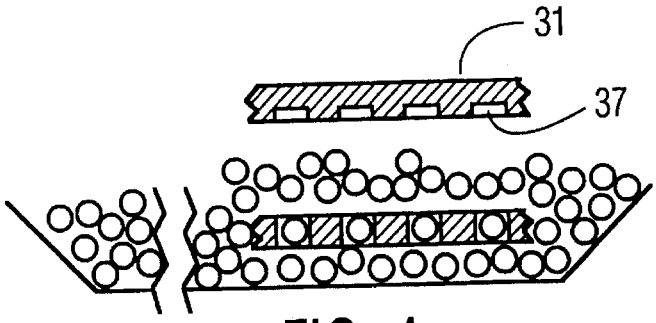

As the wheel rotates further, tooling fixture 32 enters the reservoir while the associated ball grid array remains above the reservoir. The positions of the components at this juncture of the operation are illustrated in FIG. 4. It is to be noted that ball grid array 31 has an array of recesses (37 in FIG. 4) which are facing downwards, as viewed in FIG. 4. The tooling fixture, 32, has recesses facing upwards, as viewed in FIG. 4. The recesses in the tooling fixture are dimensioned to hold only a single solder ball. Since the tooling fixture is submerged in solder balls, all the recesses in the tooling fixture become occupied.

Figure 5:
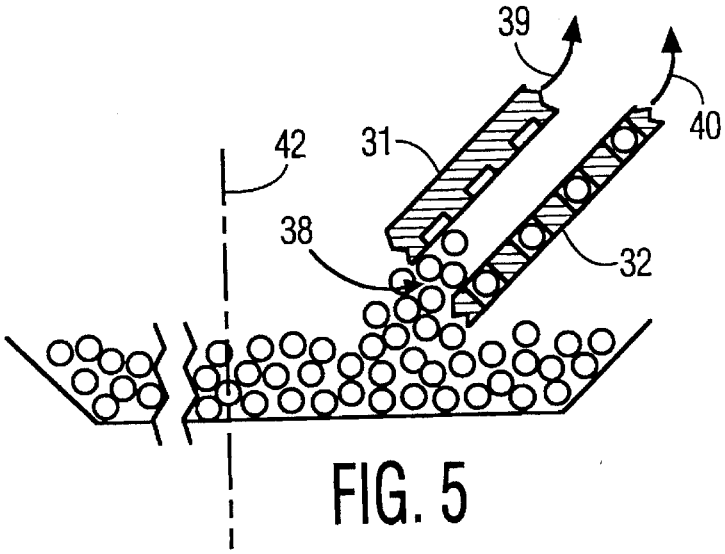

The wheel continues to rotate as illustrated in FIG. 5. Gravity acts to return excess solder balls (38) to the reservoir as the components (31 and 32) move upwards and to the right as indicated by the curved arrows 39 and 40 in FIG. 5. Wheel 20 is grounded electrically to ensure that static electricity does not act to retain excess solder balls on the surface of the tooling fixture. The now filled tooling fixture is positioned to transfer the solder balls to the associated solder ball array.

Figure 6:
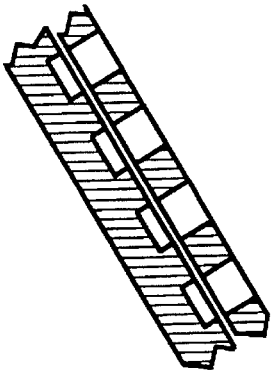

The transfer of the solder balls is accomplished by moving the tooling fixture and the associated ball grid array into juxtaposition and then moving the juxtaposed components upwards as the wheel continues to rotate counterclockwise. As the components pass the forty five degree position, with respect to a vertical reference axis 42 of FIG. 5, gravity begins to act to move the solder balls from the tooling fixture to the ball grid array. It should be clear that the continued rotation of the wheel positions the ball grid array beneath the tooling fixture whereas in FIGS. 4 and 5 the tooling fixture was beneath the ball grid array. Moreover, as shown in FIG. 6, the recesses of the ball grid array are directed upwards and the recesses of the tooling fixture are directed downwards. The recesses of the tooling fixture are dimensioned so that a solder ball is free to move in a recess and the recesses in a ball grid array are more closely dimensioned to fix the position of a solder ball therein.

The movement of a tooling fixture and an associated ball grid array into juxtaposition is accomplished, illustratively, by moving the tooling fixture along a track arranged between the associated components. The movement along a track is provided by a solenoid activated when the components are in the optimum angular position for such movement and before the wheel rotates to to a position where gravity acts to transfer the solder balls.

Figure 7:
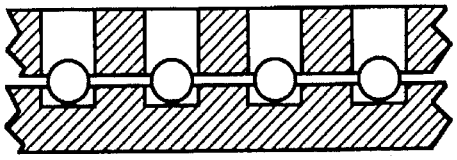
FIGS. 7, 8, and 9 are side, top and front views of an implementation of the Ferris Wheel apparatus in accordance with the principles of this invention.

FIG. 7 illustrates the "dropping" of the solder balls from the recesses in the tooling fixture to the corresponding recesses of the associated ball grid array. Note that the recesses in the ball grid array are relatively shallow to position the captured solder balls so that they protrude from the recesses as is the case with populated ball grid arrays.

In principle, apparatus, in accordance with the principles of this invention, employs gravity to transfer solder balls from a populated, juxtaposed tooling fixture and includes a mechanism to space the tooling fixture and the associated ball grid array to permit movement of only the tooling fixture into a reservoir of solder balls for temporarily capturing the solder balls for transfer at a later time to the ball grid array when the components are repositioned for gravity to effectuate the transfer.

Figure 8:
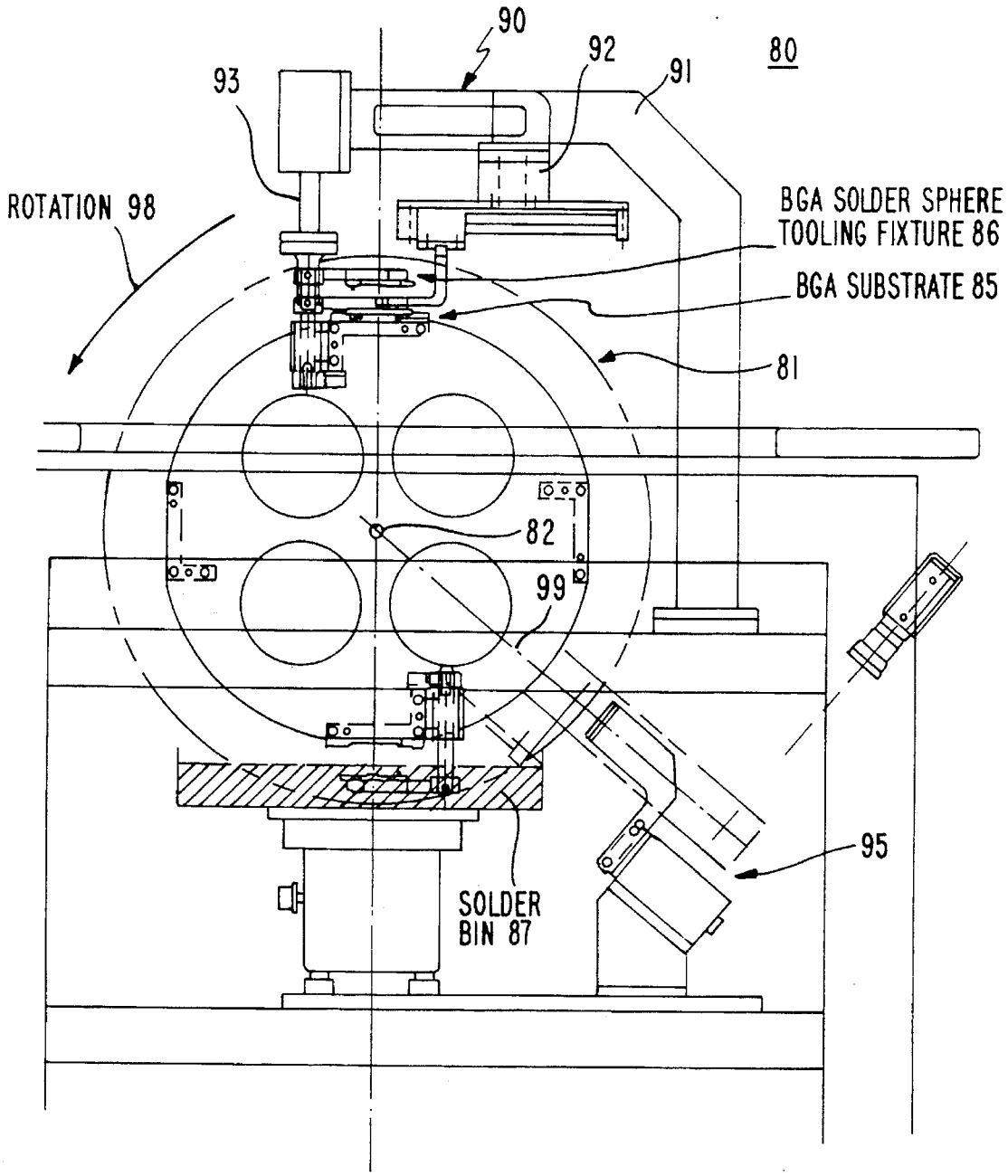
Figure 9:
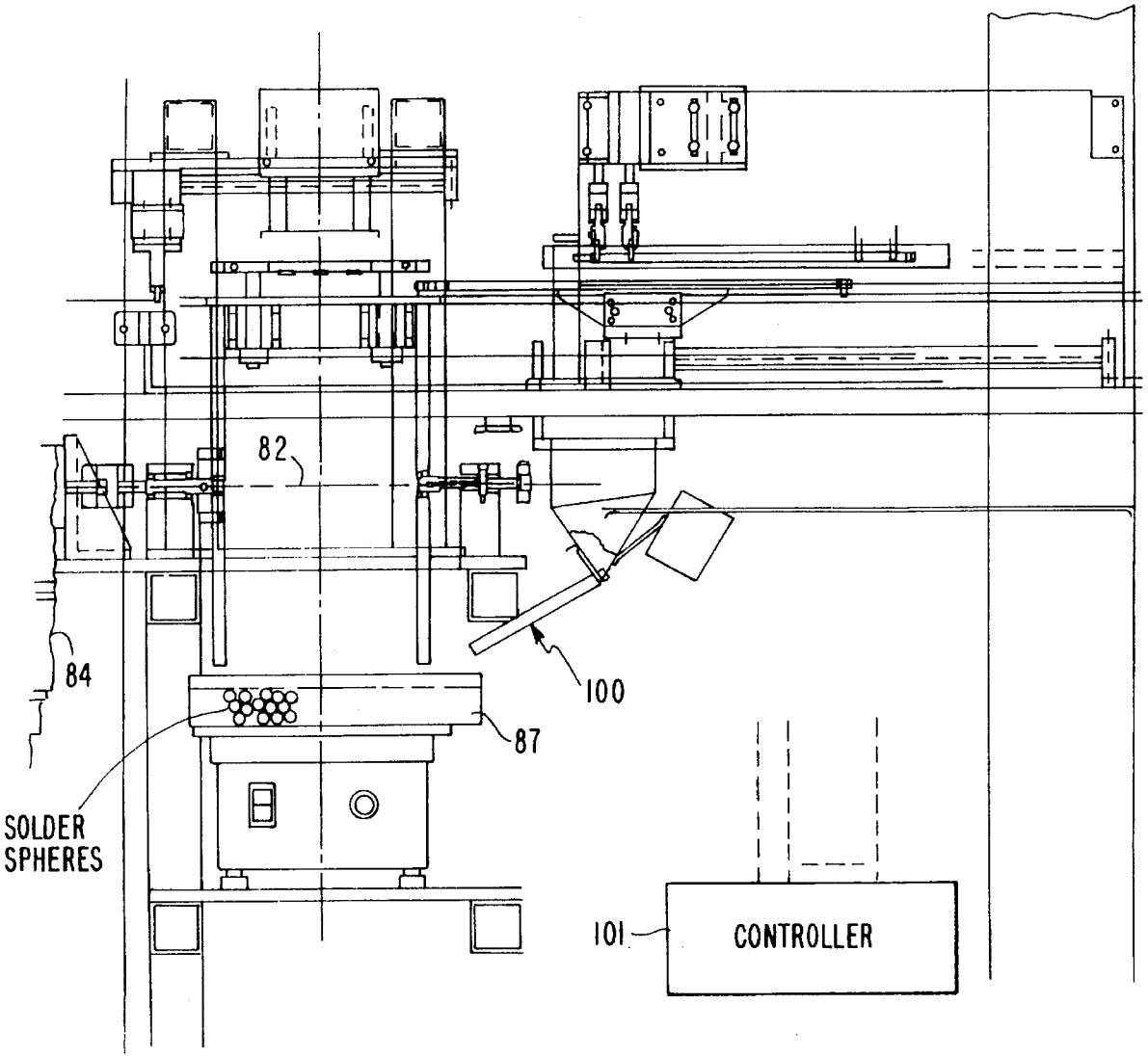

FIGS. 8, and 9 are front and end views of an implementation of the apparatus of FIG. 2.

The apparatus 80 of FIG. 8 is operative to rotate Ferris Wheel 81 illustratively counterclockwise about axis 82 in response to the energization of motor 84. As viewed in FIG. 8, the ball grid array strip 85 and the tooling fixture 86 move downward towards the solder ball reservoir. The tooling fixture and the ball grid array are spaced apart a distance to ensure that only the tooling fixture actually contacts the solder balls in the reservoir. As the tooling fixture moves through the reservoir, solder balls in the reservoir occupy the recesses with an excess of solder balls accumulating on the surface of the strip. Moreover, the solder balls which do occupy recesses are moved downwards in those recesses under the force of gravity to move to consistent and predictable positions within the recesses.

FIG. 8 also shows a positioning arrangement 90 for positioning the tooling fixtures and the ball grid array on the outer and inner faces of the wheel. The arrangement includes a support 91 from which manipulating arms 92 and 93 are suspended. Manipulating arm 92 is operative to place the ball grid arrays in position and the manipulating arm 93 is operative to position the tooling fixture. FIG. 8 also shows engagement mechanism 95 operative to move the tooling fixture and the associated ball grid array together once the tooling fixture has moved through the reservoir or bin of solder balls. FIG. 8 shows the tooling fixture and ball grid array in position at the reservoir at the bottom of the figure. Operation is counterclockwise having moved the tooling fixture and the ball grid array into the reservoir as indicated by curved arrow 98. When the components move further to a position indicated by axis 99, engagement mechanism 95 is activated to move the tooling fixture into juxtaposition with the ball grid array. The mechanism includes a clutch to retain the components in position while they are moved upwards and to the left as viewed in FIG. 8.

FIG. 9 shows an automatic solder ball or sphere loader 100. The solder ball loader is controlled by a controller 101 operative also under operator command to rotate the wheel, move the components into juxtaposition, and also fill the reservoir. Controller 101 is shown in FIG. 9 and comprises a process computer as is well understood in the art.

It should be apparant to those skilled in the art that more than one ball grid array strip may be populated in a continuous operation so long as the apparatus ensures that the solder balls remain in the recesses once they are in position in those recesses.

Although dimensions vary according to the intended use of the ball grid arrays populated in accordance with this invention, typically the outer diameter of a wheel is from twelve to fifteen inches and the inner diameter is one inch less. Such dimensions ensure that the ball grid array does not enter the reservoir of solder balls while the tooling fixture is being populated.

Further, it should be clear that more than one ball grid array or strip along with an associated tooling fixture can be positioned on the wheel for increasing the throughput of the apparatus. This is clear from FIG. 8 where associated ball grid array and fixture are shown in two positions. Two different associated ball grid arrays and fixtures could be so positioned.

Figure 10:
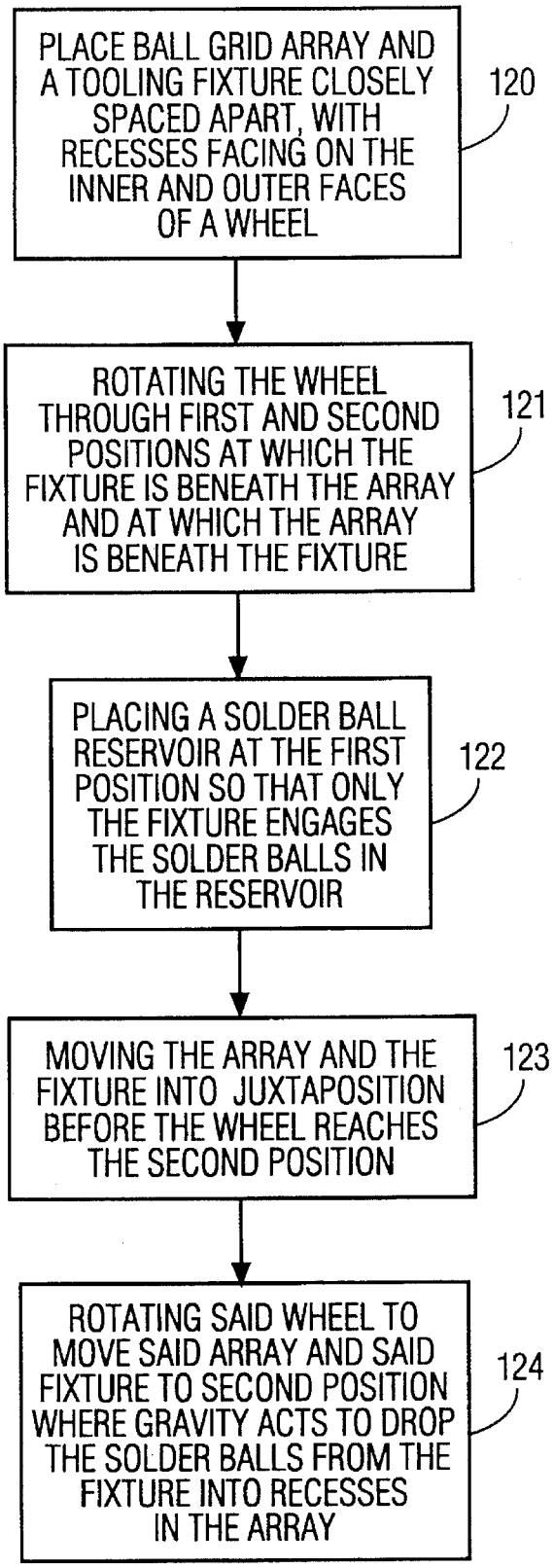
FIG. 10 is a flow diagram of the method of populating a ball grid array with the apparatus of FIG. 2.

FIG. 10 is a flow diagram of the method of operation of the apparatus of FIG. 2. The first block 120 of FIG. 10 indicates that the ball grid array and the tooling fixture are secured to the inner and the outer faces of the wheel of the apparatus with the recesses facing one another. The second block 121 indicates that the wheel is rotated through first and second positions at which the fixture is beneath the array and at which the array is beneath the fixture respectively. The third block 122 indicates that a reservoir of solder balls is located at the first position so that only the fixture enters the reservoir. Block 123 indicates that the spacing between the fixture and the array is reduced before the wheel reaches the second position. Block 124 indicates that the wheel moves to the second position at which gravity causes the solder balls to drop from the fixture into the recesses in the array. The array now is fully populated and can be removed at the position identified by the numeral 85 in FIG. 8.

What is claimed is:

1. Apparatus for placing solder balls in a ball grid array, said apparatus comprising a wheel having an inner and an outer face, said wheel being rotatable about a horizontal axis, means for attaching a ball grid array to the inner face of said wheel, means for attaching a tooling fixture to the outer face of said wheel in a position corresponding to that of said ball grid array, means for forming a reservoir of solder balls at the bottom of said wheel, means for controllably rotating said wheel to move said tooling fixture through said reservoir in a manner to fill recesses in said fixture with solder balls and to remove from the surface of said array any excess solder balls which are not occupying recesses, said inner and outer faces being separated a distance to permit said tooling fixture to engage solder balls in said reservoir while said ball grid array does not engage said solder balls.

2. Apparatus as in claim 1 wherein said means for attaching comprises means for attaching a ball grid array strip.

3. Apparatus as in claim 2 wherein said apparatus is cylindrical in geometry and is rotatable along the central axis of the cylinder.

4. Apparatus as in claim 2 wherein said means for attaching comprises means for attaching more than one ball grid array strip to said inner surface of said wheel at spaced apart positions on said surface.

5. A method for filling a ball grid array with solder balls, said method comprising the steps of placing a ball grid array on the inner face of a wheel having an inner and an outer face and being rotatable about a horizontal axis, placing a tooling fixture in a corresponding position on the outer face of said wheel, placing at the bottom of said wheel a reservoir of solder balls, and rotating said wheel to move said tooling fixture through said reservoir in a manner to avoid the movement of said ball grid array through said reservoir.

6. Apparatus for filling a ball grid array with solder balls, said apparatus comprising a reservoir for solder balls and means for moving a tooling fixture through said reservoir in a manner to populate recesses in said tooling fixture with said solder balls, said apparatus also including means for securing a ball grid array in a position corresponding to that of said tooling fixture, said ball grid array also including recesses therein, the recesses in said tooling fixture and in said ball grid array facing each other, said apparatus including means for dropping solder balls in recesses in said tooling fixture into corresponding recesses in said ball grid array under the force of gravity.

7. Apparatus as in claim 6 wherein said apparatus includes a wheel having an inner and an outer face, said fixture being attached to said outer face and said ball grid array being attached to said inner face, said means for moving comprising means for rotating said wheel.

8. Apparatus as in claim 7 wherein said wheel rotates through first and second positions at which said fixture is beneath said ball grid array and at which said ball grid array is beneath said fixture, said reservoir being located at said first position.

9. Apparatus as in claim 8 also including means for moving said fixture and said ball grid array into juxtaposition before said second position is reached and after said first position is reached.

10. A method for filling the recesses in a ball grid array with solder balls located in an array of recesses in a tooling fixture, said method comprising the steps of placing said ball grid array and said fixture in closely spaced apart positions, recesses facing, moving said array and said fixture about a circular path through first and second positions at which said fixture is beneath said array and at which said array is beneath said fixture, respectively, moving said array and said fixture into said first position such that only said fixture enters a reservoir of said solder balls, moving said array and said fixture to said second position at which gravity acts to transfer solder balls in recesses in said fixture into recesses in said array, and moving said array and said fixture into juxtaposition before said second position is reached.

* * * * *